US005210707A

United States Patent [19]

Hamamatsu

[11] Patent Number: 5,210,707

[45] Date of Patent: May 11, 1993

[54] SIGNAL MIXING APPARATUS FOR PROCESSING PARALLEL DIGITAL DATA ON A TIME SHARED BASIS USING ANALOG ADDITION

[75] Inventor: Hiroshi Hamamatsu, Hamamatsu, Japan

[73] Assignee: Yamaha Corporation, Hamamatsu, Japan

[21] Appl. No.: 573,999

[22] Filed: Aug. 28, 1990

[30] Foreign Application Priority Data

Aug. 31, 1989 [JP] Japan ..... 1-225215

[51] Int. Cl.[5] ..... G06J 7/12

[52] U.S. Cl. ..... 364/602; 341/141

[58] Field of Search ..... 364/602–608, 364/807, 861, 862; 375/5, 24; 307/440, 498; 341/108, 110, 141, 152

[56] References Cited

U.S. PATENT DOCUMENTS 4,499,549 2/1985 Bartlett ..... 364/602
4,910,515 3/1990 Iwamatsu ..... 341/110
4,929,945 5/1990 Kushiyama ..... 341/110
4,931,751 6/1990 Keller et al. ..... 375/24
4,990,915 2/1991 Kondoh et al. ..... 341/110

*Primary Examiner*—Jerry Smith
*Assistant Examiner*—Jim Trammell
*Attorney, Agent, or Firm*—Spensley Horn Jubas and Lubitz

[57] ABSTRACT

A signal mixing apparatus utilizing digital signal processing technology for mixing digital signals comprising parallel data of plural channels include an analog addition circuit for adding, in analog, data of the same bit of parallel input data in plural channels, an analog-to-digital conversion circuit for converting added analog data of respective bits to digital data, and a digital addition circuit for adding, in digital, the converted digital data of all bits together. Since the data of the same bit of parallel input data of plural channels are added together in analog through the analog addition circuit such as a bus and an analog adder, digital input data of a large number of channels can be mixed together with a small amount of wiring.

12 Claims, 7 Drawing Sheets

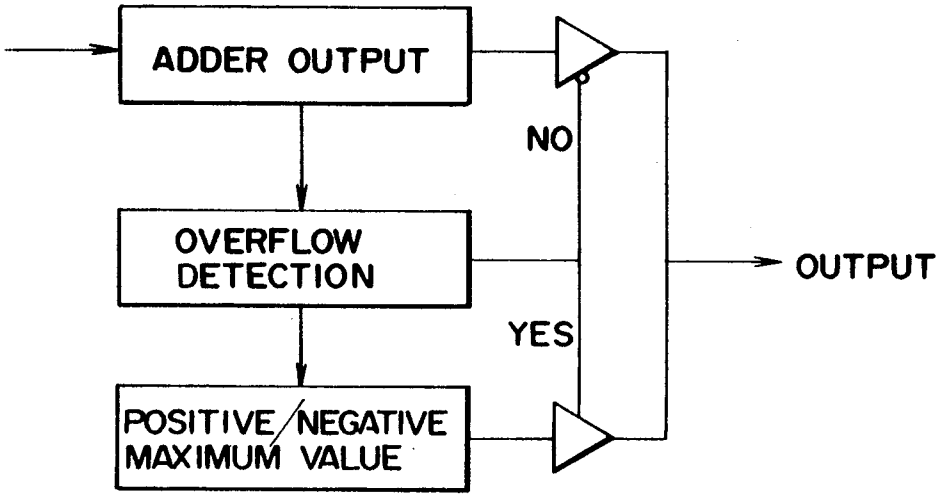
FIG. 8
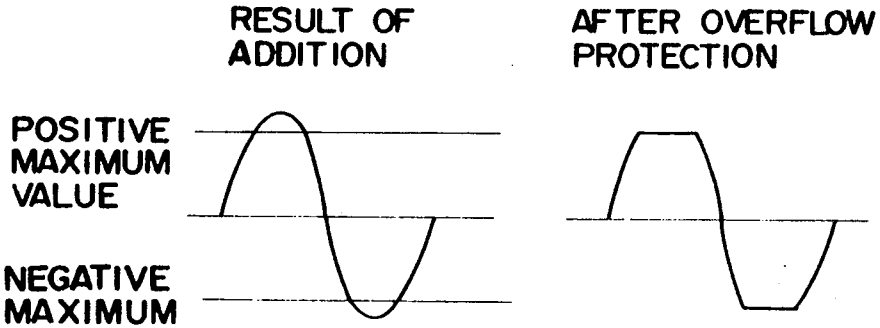
FIG. 9A
FIG. 9B
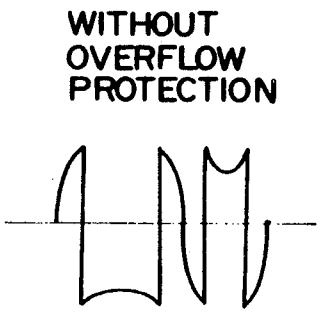
FIG. 9C

SIGNAL MIXING APPARATUS FOR PROCESSING PARALLEL DIGITAL DATA ON A TIME SHARED BASIS USING ANALOG ADDITION

BACKGROUND OF THE INVENTION

This invention relates to a signal mixing apparatus utilizing digital signal processing technology for mixing digital signals of plural channels and, more particularly, to a digital mixer capable of mixing inputs of a large number of channels with a relatively small amount of wirings.

In a prior art signal mixing apparatus utilizing digital signal processing technology used for mixing data of a relatively small number of channels, a bus is formed in such a manner that a memory is shared by plural DSPs (digital signal processors). FIG. 2 shows an example of this prior art signal mixing apparatus. In the example of FIG. 2, digital input data ch1 to ch4 of respective channels are applied to DSPs 10 and 12 for signal processing and, after holding these data in a memory 14, these data are sequentially read out and provided as mixed outputs after applying signal processing to them.

There is another prior art signal mixing apparatus using adders for mixing. FIG. 3 shows an example of this type of signal mixing apparatus. In this signal mixing apparatus, digital input signals ch1 to ch8 are applied to corresponding one of DSPs 18, 20, 22 and 24 for signal processing and thereafter are sequentially added together by adders 26, 28 and 30 and then the sum signal of all the digital input signals ch1 to ch8 is processed by a DSP 32 for outputting a mixed signal.

The prior art signal mixing apparatus of FIG. 2 is effective in a case where the number of channels or buses is relatively small. Since, however, outputs cannot be obtained from the DSP 10 and DSP 12 at the same timing, the number of times the DSPs 10 and 12 can access the memory 14 within one sampling period is limited with a result that a large number of channels or buses cannot be provided in this type of signal mixing apparatus. Further, if moduled circuits are adopted for inputs of respective channels, these moduled circuits will have to be controlled by supplying different timing signals to them because these moduled circuits will not be able to access the memory at the same timing. This will require a complicated circuit design. Besides, as a problem before considering merits and demerits of using moduled circuits, it is practically impossible for this type of digital mixer, due to inherent limitation on the speed of carrying out addition, to perform addition of data of a large number of channels for which adoption of moduled circuits is considered suitable.

The DSPs 18, 20, 22 and 24 of the signal mixing apparatus of FIG. 3 can output signals at the same timing and, accordingly, a larger number of channels or buses can be employed than in the signal mixing apparatus of FIG. 2. This signal mixing apparatus however requires a large amount of wirings since, for example, a complex wiring is required for a single DSP. Besides, in a case where moduled circuits are employed in this digital mixer, the capacity of input wirings of a master module to which the moduled circuits are to be connected is limited and fixed and, further, each one of the moduled circuits occupies a certain number of wirings and, accordingly, it is theoretically impossible to change the number of modules without limitation as in an analog mixer. It is not desirable either to increase the capacity of the master module to a large extent so that this type of signal processing device is not preferable in respect of utilizing the module.

It is, therefore, an object of the invention to provide a digital mixer capable of mixing input data of a large number of channels with a small amount of wirings and also capable of employing moduled circuits and changing the number of channels without difficulty.

SUMMARY OF THE INVENTION

A signal mixing apparatus utilizing digital signal processing technology achieving the above described object of the invention comprises input means for inputting, as channel input data, digital signals comprising parallel data, analog addition means for adding, in analog, data of the same bit of parallel input data in plural channels, analog-to-digital conversion means for converting added analog data of respective bits to digital data; and digital addition means for adding, in digital, the converted digital data of all bits together and outputting added digital data.

According to the invention, data of the same bit of parallel input data of plural channels are added in analog and then analog-to-digital converted. The converted added data of all bits are added together in digital to provide a digital mixed output.

Since, according to the invention, data of the same bit of parallel input data of plural channels are added together in analog through a bus, input data of a large number of channels can be mixed together with a small amount of wirings.

In one aspect of the invention, different kinds of data can be processed on a time shared basis by applying these different kinds of data as parallel input data on a time shared basis within one sampling period.

In another aspect of the invention, parallel input data of respective channels are supplied by moduled circuits and, accordingly, the number of input channels can be easily changed.

Embodiments of the invention will now be described with reference to the accompanying drawings.

BRIEF DESCRIPTION OF THE DRAWINGS

In the accompanying drawings,

FIG. 8 is a block diagram showing an example of an overflow protection circuit; and FIGS. 9A to 9C are waveform diagrams showing the effect of applying overflow protection.

DESCRIPTION OF PREFERRED EMBODIMENTS

Figure 1:
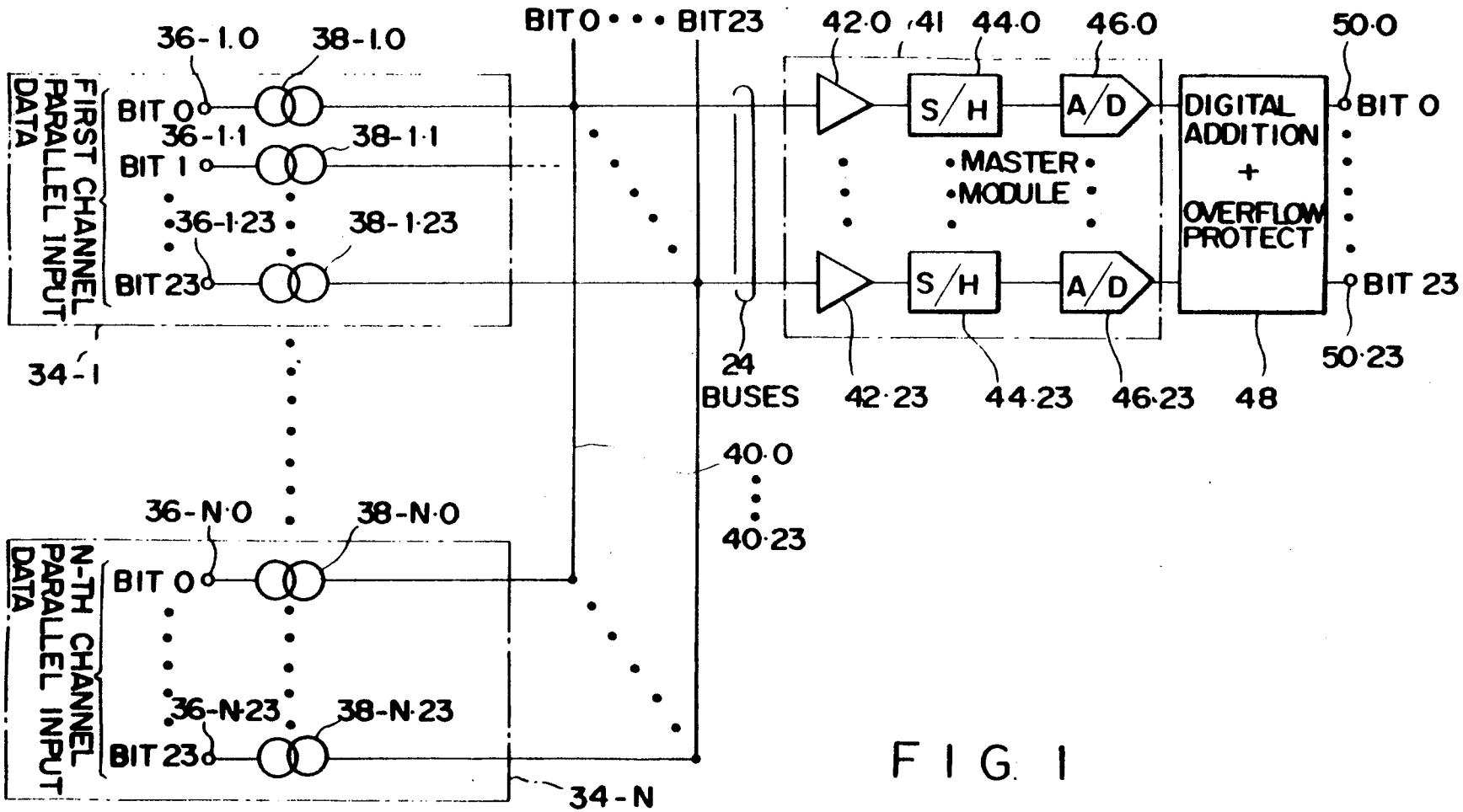
FIG. 1 is a block diagram showing an embodiment of the invention.
Figure 2:
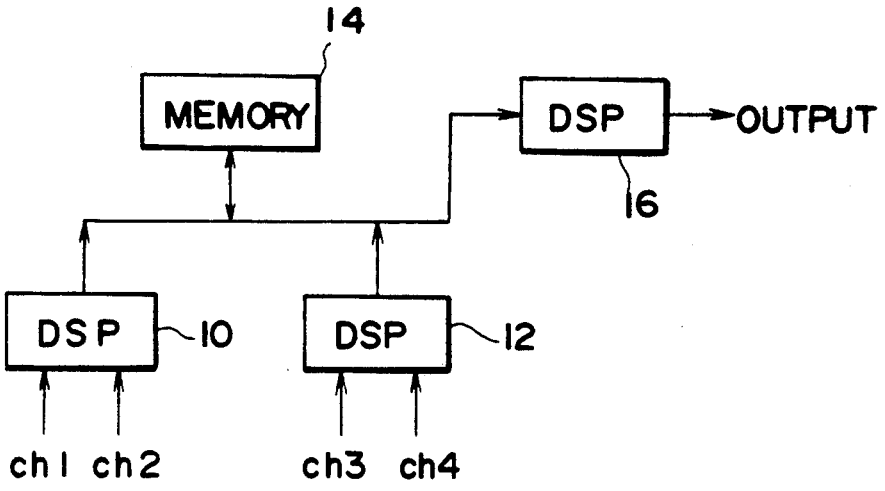
FIG. 2 PRIOR ART
FIGS. 2 and 3 are block diagrams showing prior art digital mixers.
Figure 3:
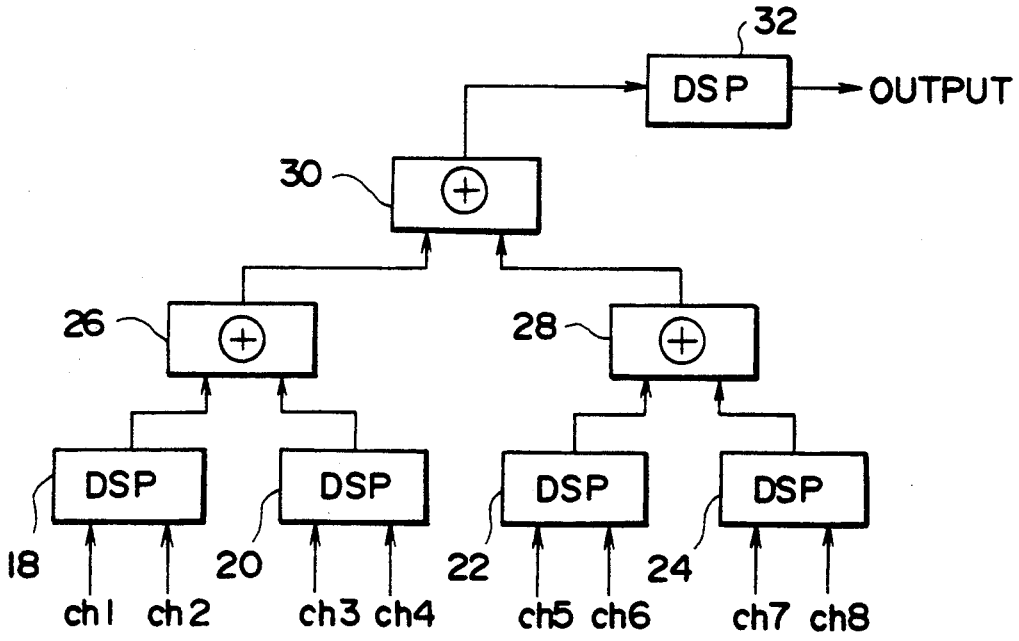
FIG. 3 PRIOR ART

An embodiment of the invention is shown in FIG. 1. This embodiment has N channels and the input circuit of each channel is modulated. Input data of one channel is expressed, for example, by 24-bit parallel data. In this embodiment, different kinds of input data are applied and processed on a time shared basis within one sampling period.

Channel modules 34-1 to 34-N respectively include input terminals 36-1.0 . . . 36-1.23 to 36-N.0 . . . 36-N.23 of 24 bits and constant current sources 38-1.0 . . . 38-1.23 to 38-N.0 . . . 38-N.23 connected to these input terminals. A constant current source corresponding to a bit input which has been turned to "1" is turned on to supply a constant current value I.

Bit output lines of the channel modules 34-1 to 34-N are respectively connected to buses 40.0 to 40.23 and bit output currents of the same bit are added together in analog through one of these buses 40.0 to 40.23 which constitute the analog addition means. A flat cable can be used for these buses 40.0 to 40.23 in the same manner as in an analog mixer. Respective current values which have been added in analog are converted to voltage values by current-voltage converters 42.0 to 42.23 in a master module 41 and the output voltage values are sample-held by sample hold circuits 44.0 to 44.23 and thereafter converted to digital signals by analog-to-digital converters 46.0 to 46.23. The added data of all bits which have thus been converted to digital signals are added together after digit matching by a digital addition circuit 48 and bit signals of a final digital mixing output are provided from output terminals 50.0 to 50.23.

Figure 6:
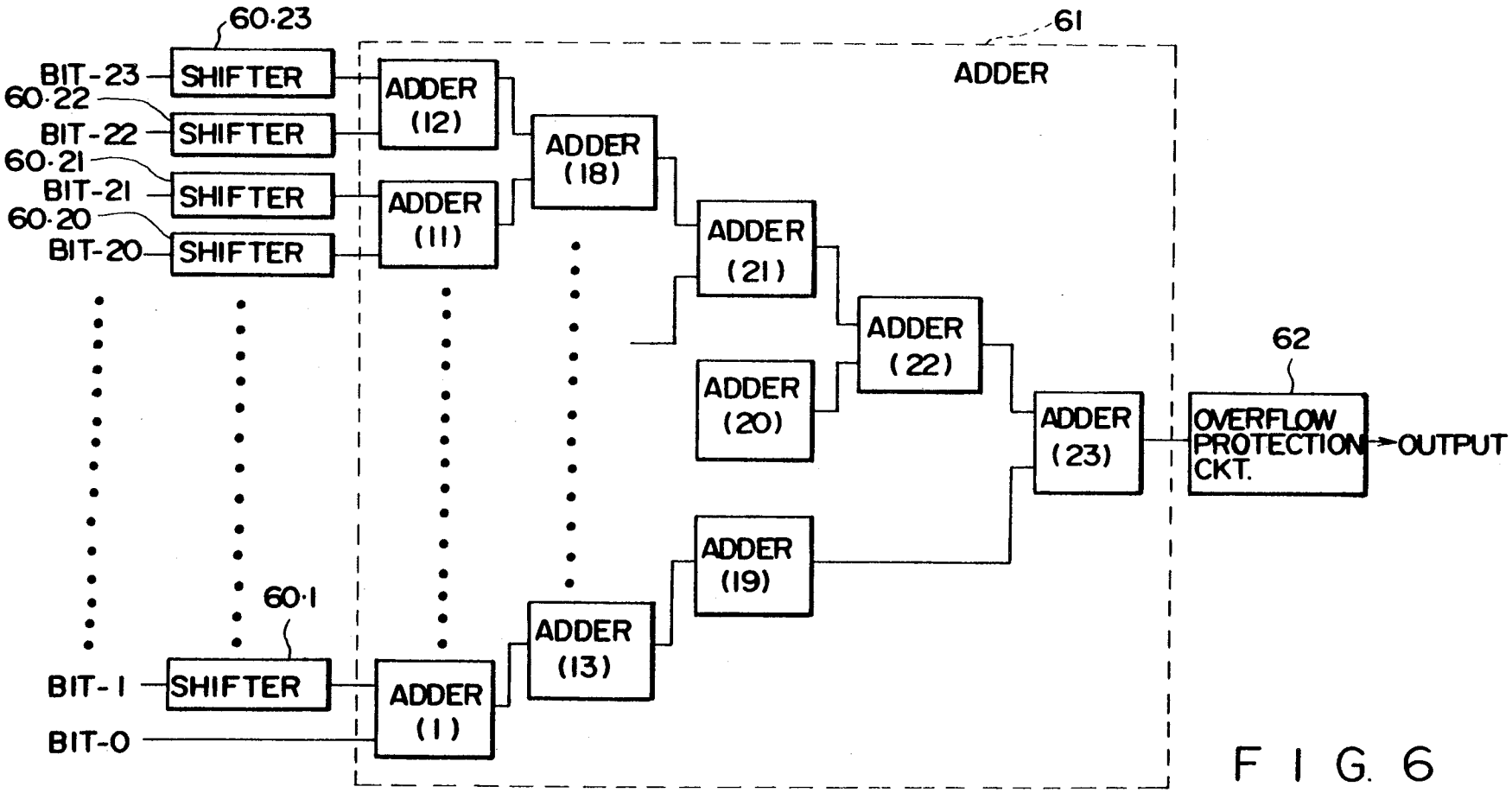
FIG. 6 is a block diagram showing an example of a digital addition circuit.

FIG. 6 shows an example of the digital addition circuit 48. Signals produced by the analog-to-digital converters 46.1 to 46.23 are subjected to digit matching through shifters 60.1 to 60.23.

Figure 7:
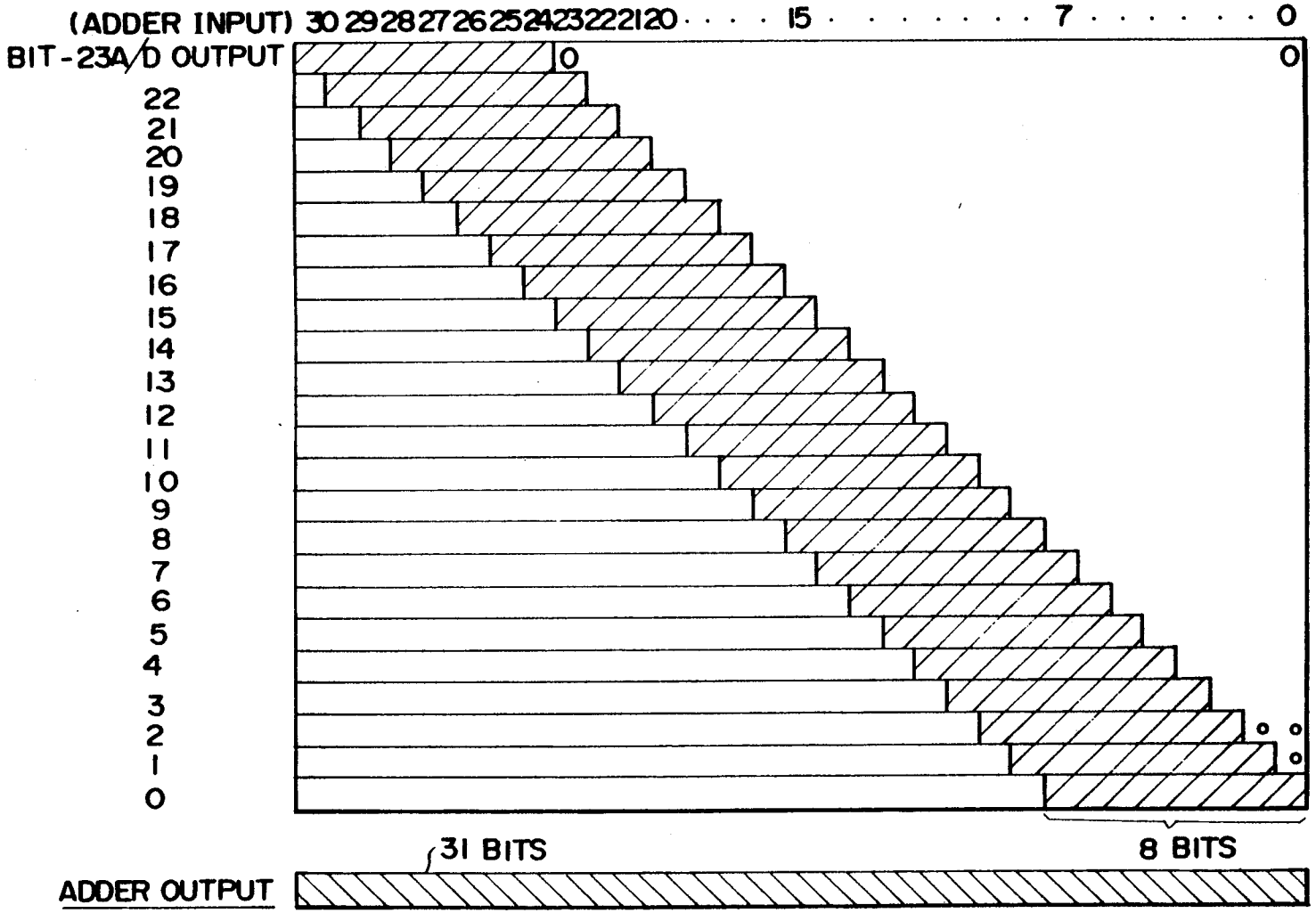
FIG. 7 is a diagram showing an example of a method of digit matching.

FIG. 7 shows an example of method of digit matching. In this embodiment, 24 data of bit-0 to bit-23 are supplied from the analog-to-digital converters 46.0 to 46.23 and each data is 8-bit data (therefore, a channel module of maximum 256 channels can be connected) so that digit matching is made by shifting the data bit by bit sequentially on the basis of bit-0. The respective data which have been subjected to digit matching by the shifters 60.1 to 60.23 are sequentially added by the adder 61 and provided as 31-bit digital data.

The output of this adder 61 is converted, when necessary, to predetermined data by an overflow protection circuit 62 an example of which is shown in FIG. 8. In a case where the output of the adder 61 has exceeded a predetermined positive maximum value or predetermined negative maximum value (e.g., upper limit or lower limit of digital bit data) as shown in FIG. 9A, if the output of the adder 61 is converted to analog data without being subjected to an overflow protection processing, resulting analog data will become one as shown in FIG. 9C which is widely different from desired analog data. For preventing this, the overflow protecting circuit 62 is provided to subject the output of the adder 61 to an overflow protection and thereby obtain data as shown in FIG. 9B which is sufficiently similar to desired data.

In the overflow protection circuit of FIG. 8, the 31-bit digital data from the adder 61 is supplied to an overflow detection stage. Since the manner of applying overflow protection is well known, detailed description thereof will be omitted. The overflow detection stage detects whether or not the result of the addition exceeds the positive maximum value or the negative maximum value and, when the overflow detection stage has detected such exceeding value, the overflow protection circuit 62 provides 24-bit data corresponding to the positive maximum value or negative maximum value instead of the result of addition whereas when the overflow detection stage has not detected such exceeding value, the overflow protection circuit 62 provides 24-bit data corresponding to the result of addition.

In the circuit of FIG. 1, the number of input channels can be readily changed simply by mounting and dismounting the channel module 34 to and from the buses 40.0 to 40.23 so that the digital mixer of this embodiment can be used in the same manner as in the conventional analog mixer. Since the input level of the analog-to-digital converters 46 varies between 0 and N, the number of input channels can be varied within a range in which digital outputs corresponding thereto can be obtained. More specifically, assuming that the output bit number of the analog-to-digital converters 46 is M, channel modules of 2M channels can be connected. If, for example, the output bit number of the analog-to-digital converters 46 is 6 bits, input data of 64 channels can be mixed together.

In the embodiment of FIG. 1, different kinds of data are applied, processed and delivered out respectively on a time shared basis.

Figure 4:
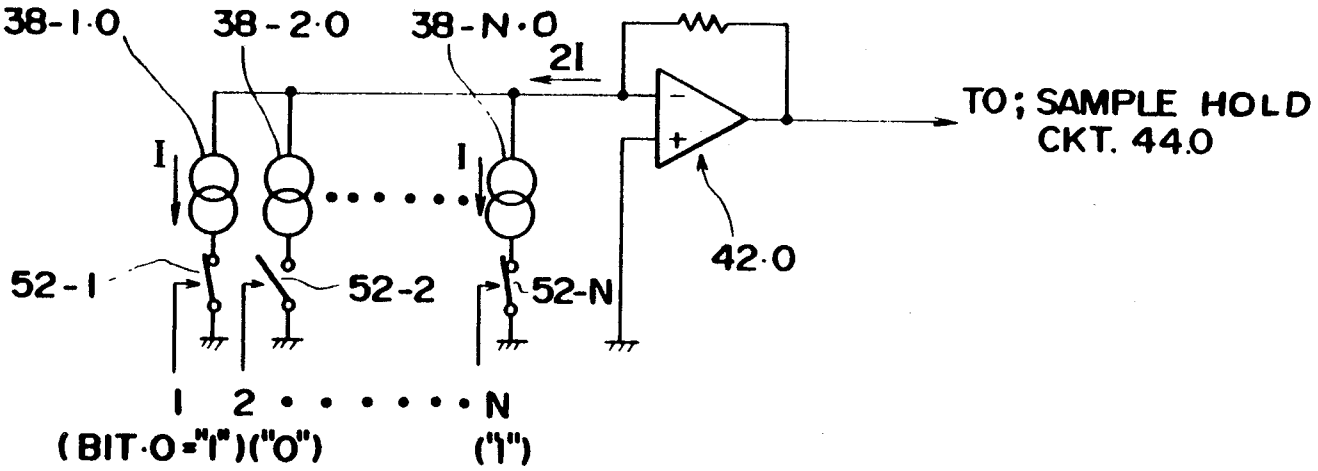
FIG. 4 is a circuit diagram showing a specific example of current addition and current-voltage conversion in FIG. 1.

A specific example of adding the bit-0 of input data of the respective channels in analog is shown in FIG. 4. Switches 52-1 to 52-N are turned on and off by signals of bit-0 in the respective channels (i.e., these switches are turned on when the bit-0 signal is "1" and turned off when the bit-0 signal is "0") and causes the constant current I to flow when these switches are on. In the illustrated example, the bit-0 signal is "1 " in the channels 1 and N and is "0" in the other channels. These currents are added together and supplied to an inverting amplifier (current-voltage converter) 42.0 in which the current is converted to corresponding voltage and delivered out. The analog addition structure which is the same as one for the bit-0signal is employed for the other bits-1 to 23.

Figure 5:
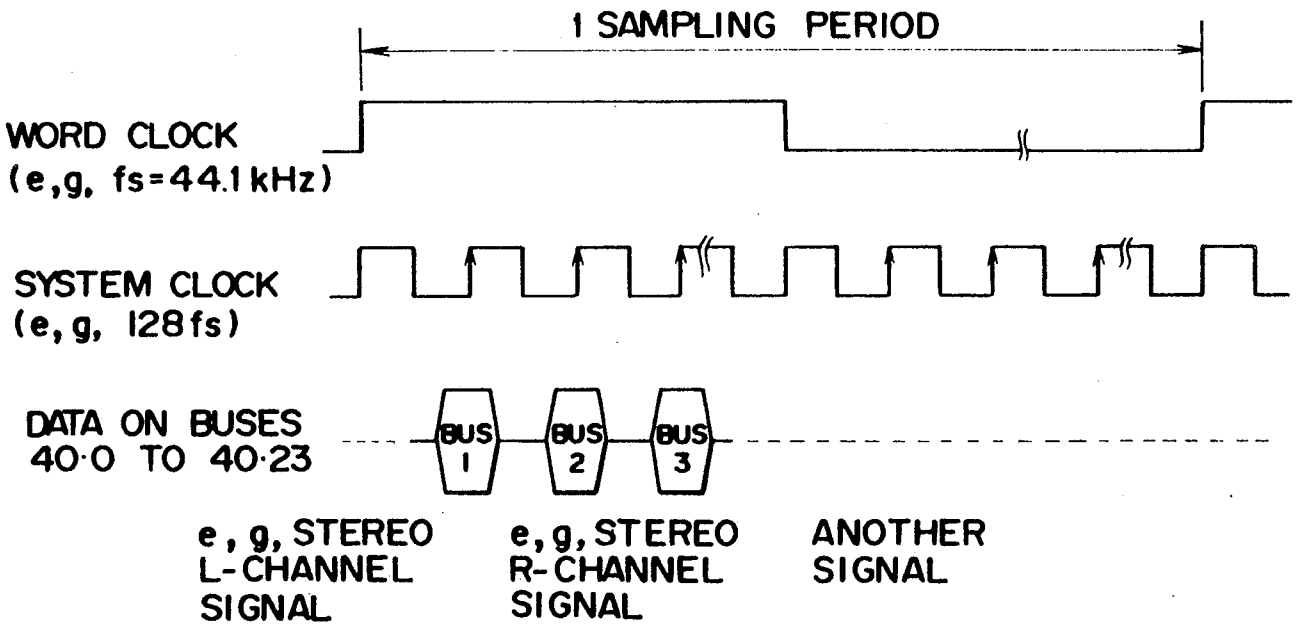
FIG. 5 is a time chart showing an example of operation timing of the circuit of FIG. 1.

An example of operation timing of the circuit of FIG. 1 shown in FIG. 5. Different kinds of data are applied on a time shared basis at each system clock and processed on a time shared basis. Assuming that the system clock has a period of 1/128 of the word clock (i.e., sampling period), data of 128 different kinds can be applied on a time shared basis and can be subjected to the mixing processing.

What is claimed is:

1. A signal mixing apparatus utilizing digital signal processing technology comprising:

input means for inputting digital signals as a plurality of parallel data bits within each of a plurality of channels;

analog addition means for adding, in analog, data of the same one of the plurality of parallel data bits within each of the plurality of channels to produce an analog sum for each of the plurality of parallel data bits;

analog-to-digital conversion means for converting the analog sum for each of the plurality of parallel data bits to digital data; and digital addition means for adding, in digital, the converted analog sums for all of the plurality of parallel data together to produce a single sum and outputting the single sum.

2. A signal mixing apparatus as defined in claim 1 wherein the inputted digital signals are derived from a plurality of different sources and are applied to said analog addition means on a time shared basis within each of a plurality of sampling periods.

3. A signal processing apparatus as defined in claim 1 wherein said input means comprises switch means for switching plural switches in response to the digital signals and said analog addition means comprises a power supply connected to said switch means and varying each of a plurality of current outputs thereof in accordance with the state of switching of said switch means and an analog adder for performing analog addition of the plurality of current outputs of said power supply.

4. A signal mixing apparatus as defined in claim 3 wherein each of the plurality of current outputs of said power supply comprises a different one of a plurality of constant current sources; and said switch means has a first side thereof connected to input terminals of the respective channels and an opposite second side thereof connected to said plurality of constant current sources for causing a constant current to flow upon receipt of an input signal, and further including a plurality of buses connected to said plurality of constant current sources for transmitting constant currents of the same one of the plurality of parallel data bits within each of the plurality of channels to said analog adder.

5. A signal mixing apparatus as defined in claim 1 wherein said analog-to-digital conversion means comprises a sample-and-hold circuit for sampling and holding analog sums from said analog addition means and an analog-to digital converter for analog-to-digital converting the analog sums sampled and held by said sample-and-hold circuit.

6. A signal mixing apparatus as defined in claim 1 wherein the analog-to-digital conversion means performs digital matching of the digital data to produce digit matched digital data and said digital addition means adds the digit matched digital data from said analog-to-digital conversion means.

7. A signal mixing apparatus as defined in claim 6 further comprising an overflow protection circuit for detecting whether the added digit matched digital data is overflowing or not and changing the digit matched digital data when the added digit matched digital data is overflowing.

8. A signal mixing apparatus utilizing digital signal processing technology comprising:

a plurality of channel module portions, each inputting digital signals consisting of a plurality of different parallel data bits and providing signals corresponding to the parallel data bits; and a master module portion connected to the plurality of channel module portions and comprising:

analog addition means for adding, in analog, data of the same one of the plurality of parallel data bits from each of said plurality of channel module portions to produce an analog sum for each of the plurality of parallel data bits;

analog-to-digital conversion means for converting the analog sum for each of the plurality of parallel data bits to digital data; and digital addition means for adding, in digital, the converted analog sums for all of the plurality of parallel data together to produce a single sum and outputting the single sum.

9. A signal mixing apparatus comprising:

a plurality of channels;

a plurality of channel modules connected to the plurality of channels, each channel module comprising input means for inputting digital parallel data from one of the plurality of channels, and conversion means for converting respective bit data of the digital parallel data into a plurality of analog signals, the plurality of analog signals respectively representing bit data of the plurality of digital parallel data;

a master module connected to said plurality of channel modules and comprising a plurality of bit addition devices, each bit addition device having analog addition means for respectively inputting analog signals corresponding to a same bit from the plurality of channel modules and for mixing input signals, and analog-to-digital conversion means for converting mixed signals from said addition means into digital signals; and digital addition means for inputting a plurality of digital data from the plurality of bit addition devices, for bit-matching the plurality of digital data and for adding a plurality of bit-matched digital data.

10. A signal mixing apparatus as defined in claim 9 wherein the input means comprises input terminals of the same number as the bit number of the digital parallel data.

11. A signal mixing apparatus as defined in claim 9 wherein the conversion means comprises current sources of the same number as the parallel data and switch means of the same number as the parallel data, said switch means turning on and off outputs of the current sources in accordance with input bit data.

12. A signal mixing apparatus as defined in claim 9 wherein the number of bit addition devices is the same as the bit number of each digital parallel data.

* * * * *